United States Patent [19]

Jakobs

[11] 4,421,502

[45] Dec. 20, 1983

[54] WORM CENTRIFUGE

[75] Inventor: Willy Jakobs, Cologne, Fed. Rep. of Germany

[73] Assignee: Klockner-Humboldt-Deutz AG, Fed. Rep. of Germany

[21] Appl. No.: 343,403

[22] Filed: Jan. 28, 1982

[30] Foreign Application Priority Data

Jan. 30, 1981 [DE] Fed. Rep. of Germany ..... 3103029

[51] Int. Cl.[3] ..... B04F 9/02

[52] U.S. Cl. ..... 494/7; 494/53

[58] Field of Search ..... 494/7, 8, 9, 50, 51, 494/52, 53; 366/222, 223, 224

[56] References Cited

U.S. PATENT DOCUMENTS 4,240,578 12/1980 Jackson ..... 494/8

4,299,353 11/1981 Bruning ..... 494/7

FOREIGN PATENT DOCUMENTS 1178791 9/1961 Fed. Rep. of Germany .

2131087 6/1971 Fed. Rep. of Germany .

2849547 11/1978 Fed. Rep. of Germany .

*Primary Examiner*—Robert W. Jenkins

*Attorney, Agent, or Firm*—Hill, Van Santen, Steadman & Simpson

[57] ABSTRACT

A worm centrifuge with a rotatable drum and a rotatable screw therein and separate drives with a speed governable clutch between the drives to provide for a start-up by one of the drives, preferably a speed governable drive, and arranged so that the clutch can be released for independent driving of the drum and screw during normal operation.

10 Claims, 1 Drawing Figure

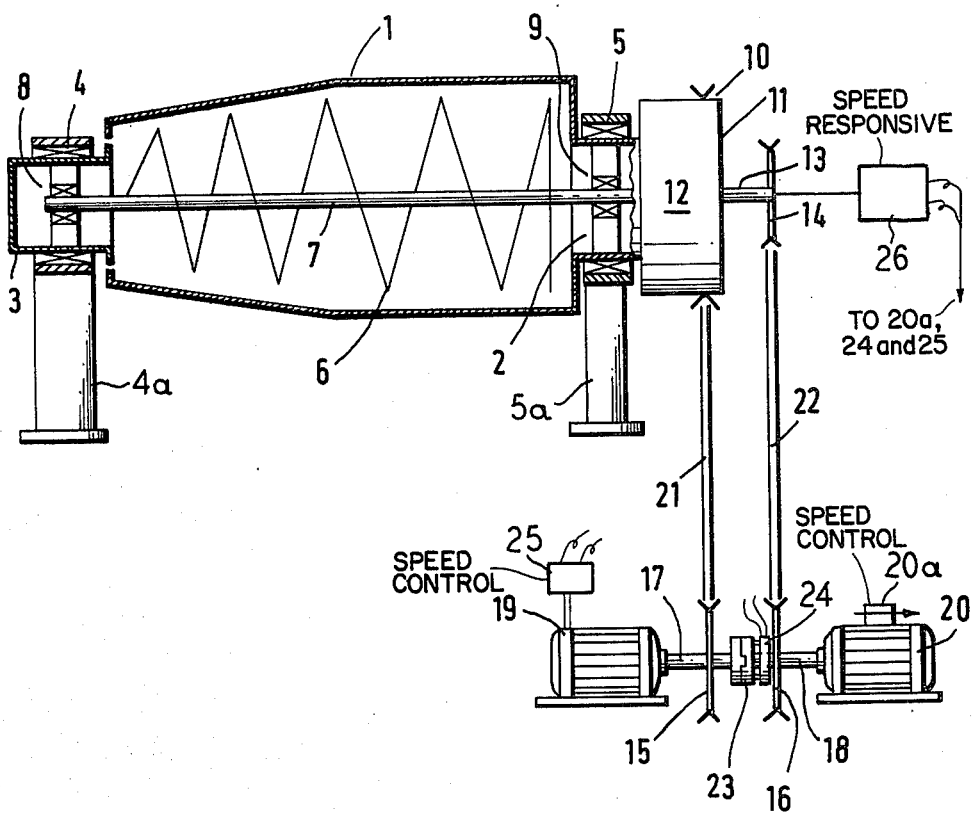
1
9
5
10
11
SPEED
RESPONSIVE
8
4
13
12
14
7
26
3
TO 20a,
24 and 25
6
2
4a
5a
22
21
SPEED
CONTROL
25
20a
SPEED
CONTROL
17
24
20
19
15
18
23
16

WORM CENTRIFUGE

BACKGROUND OF THE INVENTION

The present invention relates to improvements in worm centrifuges of the type having a rotatable outer drum and a rotatable inner conveying screw driven by independent drives with means for interconnecting the drives during start-up and one of the drives being a speed regulatable drive.

In centrifuge drives which have been used heretofore such as shown in German Laid Open Application 2,131,087 and German Allowed Application 1,178,791, the drive for the drum is not speed regulatable in contrast to the drive for the conveying screw. In the design and dimensioning of the drive for the drum, the high moment of inertia of the drum must be considered in the design of the asynchronous motors which are usually employed. The recognized heating caused by the respective current consumption and time have to be taken into consideration. In order to keep the start-up phase and the motor heating which occurs during the start-up phase within justifiable limits, asynchronous motors of correspondingly high power must be employed. However, after the start-up has been achieved, these are operated far below their nominal power in order to maintain a stationary operation of the centrifuge drum which results in poor efficiency. In contrast thereto, the use of a speed controlled motor for starting up the drum as is shown in Laid Open German Patent No. 2,849,547, makes possible a controlled slow start-up and a motor with lower power can be incorporated to satisfy requirments of energy of the operation after start-up has been accomplished. The slow start-up operation is without significance because of the lower start-up frequency of such centrifuges. Although a speed controllable drive is more expensive per se than an asynchronous motor, the centrifuge drive according to German Laid Open Patent No. 2,849,547 makes use of the fact that a speed controllable drive already exists for the worm drive. It is, therefore, proposed to also employ this drive for the conveying screw in starting up the centrifuge as well as operating the centrifuge after start-up has been accomplished. This will cover the further energy requirements by means of an asynchronous motor which can then be designed only in accord with the power required for the normal stationary operation and thus can be significantly smaller than known drives employed for this purpose.

An object of the invention is to further improve the centrifuge drive of German Laid Open Patent No. 2,849,547, particularly in providing better economics and better operation. With a centrifuge of the type referred to above, this objective is achieved by the present invention in that the output shafts of the separate drives used for the centrifuge drum and the conveying screw are directly connected to each other by a releasable coupling or clutch.

By this construction, structural changes which would otherwise be necessary at the centrifuge are eliminated. The arrangement of the present invention is also useful in the oonversion of older centrifuges since structural changes need only be undertaken in the area of the drive motors themselves. A start-up to the centrifuge by means of the speed controllable drive can be accomplished using the output shaft of the non-speed controllable drive for the drum which is on-line without being driven by the power drive for the drum during the start-up phase. The location or provision of a coupling between the shafts of the drive motors driving through the drive trains to the drum and screw permits at starting of the centrifuge a slip between the drum and screw corresponding to the gear ratio of the gearing in the drive to the drum or in the drive to the conveying screw if a ratio is used in the conveying screw drive. The advantages described above are important, particularly when solid components already exist in the drum before start-up. With this arrangement, a start-up with slip guarantees a conveying effect of the conveying screw in the direction toward the solids discharge of the drum directly at the beginning of the start-up operation so that plug-ups or material backups are prevented.

In one preferred form of the invention, the output shafts of both power means are connected to the drum and to the screw by means of belt drives with different drive ratios. By this arrangement, the belt drive connecting the output shaft of the drive means for the drum is a geared down or speed reduction drive. This geared down ratio results in increase of the effect of torque which is applied to the drum, and this is important at start-up due to the high moment of inertia of the drum. A further advantage, and in particular an economic advantage is present when a hydraulic system is employed as the speed controllable power means. For the existing geared down drive for the drum, this renders possible the employment of a high speed hydraulic engine or power means which requires only a small structural space and which can provide the same power output but is significantly more cost favorable than a low speed structure which generates a high torque. Thus, capital costs of the centrifuge drive can be appreciably reduced.

The objects and advantages of the invention will be more clearly understood in connection with the disclosure of the preferred embodiment in the single FIGURE of the drawing in which:

DESCRIPTION OF THE DRAWING

The drawing is a single FIGURE illustrating schematically a centrifuge embodying the principles of the present invention.

DESCRIPTION

A cylindrical conically shaped centrifuge drum is shown at 1 being rotatably supported at both ends on hollow drum journals 2 and 3 which are supported in bearings 4 and 5 on support columns 4*a* and 5*a*.

Within the drum is a conveying screw 6 having its shaft 7 rotatably supported within the drum and coaxially therewith on bearings 8 and 9 which bearings are adequately supported within the hollow journals 2 and 3 at the ends of the drum.

A first drive means is provided for driving the drum in rotation which includes a pulley 10 mounted on a housing 11 of a gearing 12. The gearing 12 is a reduction gearing and is connected to drive the drum 1 through the hollow journal 2.

Extending through the center of the gearing 12 is the conveying screw shaft 7 and its extension is shown at 13 driven by a pulley 14.

The pulley 10 for driving the drum is driven by the belts 21 which pass over a drive pulley 15 and constitute the first drive means, the function of which is to drive the drum.

The pulley 14 is driven by V-belts 22 which are driven by a pulley 16 and constitute a second drive means, the function of which is to drive the screw.

The first and second drive means are connected to be driven by power means shown in the form of motors 19 and 20 having output shafts 17 and 18 which respectively mount the pulleys 15 and 16. The power drive motors 19 and 20 may be electrical or hydraulic motors with the motor 19 being a fixed speed power motor and motor 20 being a variable speed motor controlled by a speed control 20*a*.

In a preferred form, the second drive means including the belt drive 22 has a drive ratio of approximately 1:1. The first drive means including the belt drive 21 for driving the drum 1 is a geared down drive.

The power output shafts 17 and 18 are releasably interconnected by means of a coupling or clutch 23. The clutch is provided with a control shown schematically at 24 for engaging and for disengaging the clutch 23. The clutch is shown schematically in the drawing, but various suitable arrangements may be employed such as an electrical, mechanical, hydraulic or even pneumatic clutch.

The power motor 19 is made operative or inoperative by a motor operator 25 which is operated to leave the motor 19 disconnected during start-up and to start the motor 19 in the drive mode after the drum reaches operating speed and normal operating conditions.

The clutch can be operated manually, but in a preferred arrangement, it is operated responsive to the drum reaching operating speed. For this reason, a speed responsive control 26 is connected to either the drum or the screw, or both, and is shown as connected to the screw drive shaft 13. The speed responsive control is connected to one or both of the clutch 24 and the control 25.

In operation, the power drive 20 is first turned on with the clutch 23 engaged. The drive 19 is on-line without load during start-up or run-up speed of the centrifuge. Due to the different gear ratios of the drives, as amplified by the gearing 12, the centrifuge is operated from the beginning of the start operation with an effective slip or speed differential between the screw 6 and the drum 1. In other words, the drum is operated more slowly at the very beginning, and the conveying screw 6 commences immediately after the beginning of start-up to move a solids component which may be present in the drum toward the discharge within the journal 2 in the shortest possible time. By means of operating the speed control 20*a*, start-up can be gradual to gain speed and overcome the inertia of the loaded drum 1. As soon as the centrifugal drum has reached its operating speed, the clutch 23 is disconnected and simultaneously the control 25 turns on the drive motor 19 which takes over the load of the rotating drum 1, and the drive 20 from that time on only drives the screw 6.

Depending on operational requirements, the speed of the conveying screw can be matched to changing demands by varying the speed of the power means 20 through the speed control 20*a* while a constant speed of the power means 19 is maintained.

While the control devices are shown schematically, it will be apparent to those skilled in the art that various mechanical, electrical or hydraulic devices may be utilized for the operative controls shown.

The arrangement illustrated shows the preferred form of structure employed, but from the foregoing, variations will become more apparent. For example, the speed controllable drive 20 and 20*a* can be designed as a hydraulic motor which offers advantages in combination with the belt drives 21 and 22. Instead of employing the preferred illustrated belt drives, other gearing or power transmission means producing the same speed transmission ratios may be employed.

I claim as my invention:

1. A worm-type centrifuge comprising in combination:

a rotatably mounted drum for containing material to be centrifuged;

a conveying screw rotatably mounted within the drum for coacting with the drum in processing of said material;

first and second drives respectively connected to drive the drum and the screw in rotation;

first and second power means respectively connected to drive said first and second drives;

and releasable clutch means located between the power means for interconnecting the power means and drives to drive the screw and drum in unison at start-up and for being disconnected for independent driving of the drum and screw during normal operation.

2. A worm-type centrifuge constructed in accordance with claim 1:

wherein said drives have different speed transmission ratios between the power means and said drum and said screw.

3. A worm-type centrifuge constructed in accordance with claim 2:

wherein said drives embody belts passing over sheaves.

4. A worm-type centrifuge constructed in accordance with claim 1:

wherein said first drive incorporates a speed reduction between the first power means and the drum.

5. A worm-type centrifuge constructed in accordance with claim 1:

wherein said second power means includes a speed control for varying the speed thereof.

6. A worm-type centrifuge constructed in accordance with claim 1:

including a speed responsive means connected to one of said drum and screw and operatively connected to said clutch to disconnect the clutch at a predetermined speed.

7. A worm-type centrifuge constructed in accordance with claim 6:

wherein said speed responsive means is connected to respond to the speed of the screw.

8. A worm-type centrifuge constructed in accordance with claim 1:

including a speed responsive means connected to one of said drum and screw and connected to control said clutch and connected to control a speed control means for said second power means.

9. A worm-type centrifuge constructed in accordance with claim 1:

including an operative control for operating said first power means.

10. A worm-type centrifuge constructed in accordance with claim 1:

including a speed responsive means responsive to the speed of one of said drum and screw and connected to control the control means of the first power means and also connected to control said clutch and a speed control for said second power means.

* * * * *